US007488190B2

(12) United States Patent
Takahashi et al.

(10) Patent No.: US 7,488,190 B2
(45) Date of Patent: Feb. 10, 2009

(54) LEVER FITTING-TYPE CONNECTOR

(75) Inventors: Toshiharu Takahashi, Makinohara (JP); Tomoyuki Miyakawa, Utsunomiya (JP); Motoyoshi Suzuki, Makinohara (JP); Hisao Asaumi, Wako (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/703,652

(22) Filed: Feb. 8, 2007

(65) Prior Publication Data

US 2007/0190833 A1 Aug. 16, 2007

(30) Foreign Application Priority Data

Feb. 14, 2006 (JP) ..... 2006-035928

(51) Int. Cl.
*H01R 13/62* (2006.01)

(52) U.S. Cl. ..... 439/157; 439/372

(58) Field of Classification Search ..... 439/157, 439/352, 372
See application file for complete search history.

(56) References Cited

U.S. PATENT DOCUMENTS 5,017,149 A * 5/1991 Hatanaka ..... 439/157
5,833,484 A 11/1998 Post et al.
6,183,278 B1 * 2/2001 Hirasawa et al. ..... 439/157
6,322,388 B1 * 11/2001 Akio et al. ..... 439/459
6,712,635 B1 * 3/2004 Nimura ..... 439/352

FOREIGN PATENT DOCUMENTS

DE 19614978 A1 4/1996
JP 9-259971 10/1997
JP 9-259971 A 10/1997

* cited by examiner

*Primary Examiner*—Thanh-Tam T. Le
(74) *Attorney, Agent, or Firm*—Sughrue Mion, PLLC

(57) ABSTRACT

A lever fitting-type connector has a lock arm for retaining a lever, the lock arm being provided at a connector housing. The lever fitting-type connector includes, in addition to a first retaining cancellation structure for canceling a retained condition of the lever by the finger, a second retaining cancellation structure for canceling the retained condition by inserting a retaining cancellation jig in a direction intersecting a direction of pressing of the lock arm and then by operating the jig. The second retaining cancellation structure includes a jig guide serving as a lever fulcrum for the retaining cancellation jig.

3 Claims, 6 Drawing Sheets

LEVER FITTING-TYPE CONNECTOR

BACKGROUND OF THE INVENTION

1. Field of the Invention

This invention relates to a lever fitting-type connector having a lever pivotally mounted on a connector housing.

2. Related Art

There is widely known a lever fitting-type connector in which in order to reduce an insertion force required for connecting connector housings together, the connector housings can be fitted together and disconnected from each other by pivotally moving a lever (see, for example, JP-A-9-259971 Publication). After the lever of the lever fitting-type connector is thus operated to be pivotally moved, this lever is retained by a lock arm formed at the connector housing so that the lever will not be inadvertently operated.

In the conventional lever fitting-type connector 1, when canceling the retaining engagement between the lock arm (not shown) of the connector housing 2 and the lever 3, an operation by the thumb 4 need to be effected at the side of the connector housing 2 as shown in FIG. 5. Therefore, in the case where such lever fitting-type connectors 1 and 1' are arranged in a juxtaposed manner as shown in FIG. 6, there is encountered a problem that these connectors must be so designed that a sufficient operation space S for the thumb 4 (see FIG. 5) can be secured. Therefore, in the case of achieving a compact design, for example, of an equipment 5 in which the lever fitting-type connectors 1 and 1' are arranged in a juxtaposed manner, there is encountered a problem that such compact design can not be satisfactorily attained because of the need for the operation space S.

The lock arm (not shown) is protected by a cover portion (Reference numeral is omitted) provided around this lock arm. Namely, the cover portion is formed at the connector housing 2 so that the lock arm will not be inadvertently operated. Because of the provision of the cover portion, the lock arm (not shown) can not be operated from any direction other than an arm-pressing direction. Therefore, the lever fitting-type connectors 1 and 1' must be so designed as to secure the sufficient operation space S for the thumb 4, and therefore there is encountered a problem that the compact design can be not satisfactory achieved.

Furthermore, in the conventional lever fitting-type connector 1, it is necessary to effect the operation (see FIG. 5) for pulling up or lifting the lever 3 while pressing the lock arm (not shown) with the thumb 4, and therefore there is encountered a problem that because of this operation the burden on the operator engaged in the connector connecting/disconnecting operation becomes heavy.

SUMMARY OF THE INVENTION

This invention has been made in view of the above circumstances, and an object of the invention is to provide a lever fitting-type connector in which a compact design of an equipment can be achieved, and also the efficiency of a connecting/disconnecting operation can be enhanced.

(1) According to first aspect of the invention, the above object has been achieved by a lever fitting-type connector which has a lock arm for retaining a lever, a first retaining cancellation structure for canceling a retained condition of the lever by the finger, and a second retaining cancellation structure for canceling the retained condition by inserting a retaining cancellation jig in a direction intersecting a direction of pressing of the lock arm and then operating the jig, wherein the second retaining cancellation structure is provided at a protection portion which protects the lock arm.

In the present invention having the above features, the retained condition can be canceled by pressing the lock arm with the finger, and alternatively the retained condition can be canceled by pressing the lock arm by the use of the retaining cancellation jig. The lever fitting-type connector of the invention has such a structure that the desired cancellation method can be selected depending on the arrangement of the connectors. Incidentally, when comparing the operation for pulling up or lifting the lever while canceling the retained condition by pressing the lock arm with the finger with the operation for merely lifting the lever after canceling the retained condition by pressing the lock arm with the use of the retaining cancellation jig, the latter operation imposes a less burden on the operator.

The connector of the present invention has such a structure that the retained condition of the lever and the lock arm can be canceled even when a sufficient operation space for enabling the finger to cancel the retained condition is not available. In order that the retained condition can be cancelled even when a sufficient operation space is not available, the connector of the present invention is provided with the second retaining cancellation structure for canceling the retained condition from the direction intersecting the direction of pressing of the lock arm. This second retaining cancellation structure is provided at the protection portion protecting the lock arm. More specifically, one example of the protection portion is an arm-protecting cover portion or the like provided around the lock arm (at least around a pressing portion of the lock arm). The present invention is particularly useful when the lever fitting-type connectors are arranged in a juxtaposed manner on an equipment.

(2) According to second aspect of the invention, the second retaining cancellation structure provided at the protection portion may include a jig guide serving as a lever fulcrum for the retaining cancellation jig.

In the invention having the above feature, the retaining cancellation jig and the jig guide jointly form a lever arrangement. The retained condition of the lever and the lock arm is canceled utilizing leverage. A force required for canceling the retained condition is small.

(3) According to third aspect of the invention, the jig guide may have a groove-like shape.

In the invention having the above feature, the insertion of the retaining cancellation jig can be easily effected. And besides, the structure of a mold for forming the resin-molded part is more simplified as compared with the case where the jig guide is in the form of a hole.

In the first aspect of the invention, there are achieved advantages that the compact design of the equipment can be achieved and that the efficiency of the connecting/disconnecting operation can be enhanced. In the second aspect of the invention, there is achieved an advantage that the operation efficiency can be further enhanced. In third aspect of the invention, there are achieved advantages that the operation efficiency can be still further enhanced and that the structure of the mold is not complicated.

DETAILED DESCRIPTION OF THE PREFERRED EMBODIMENTS

Figure 1:
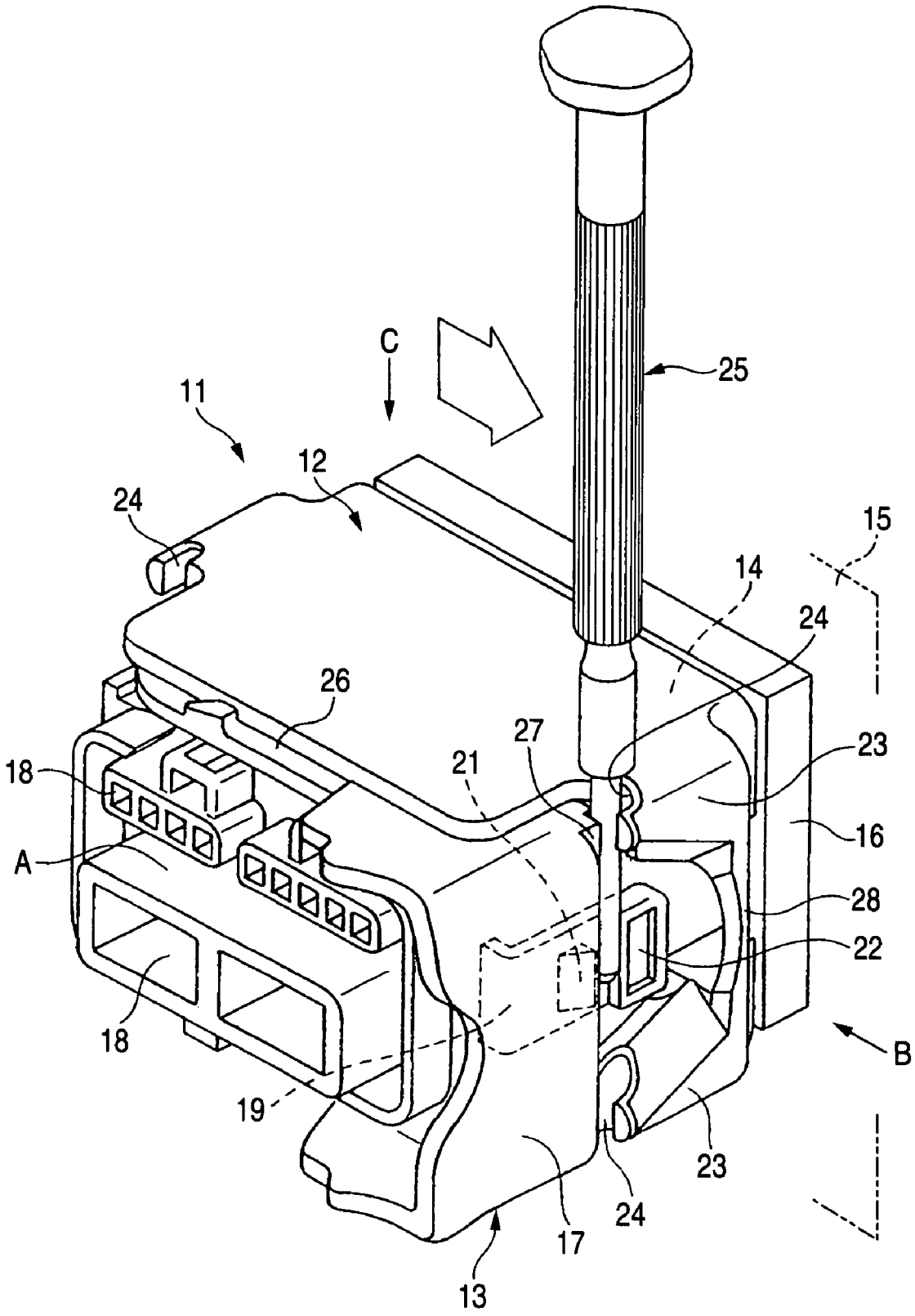
FIG. 1 is a perspective view of one preferred embodiment of a lever fitting-type connector of the present invention.
Figure 2:
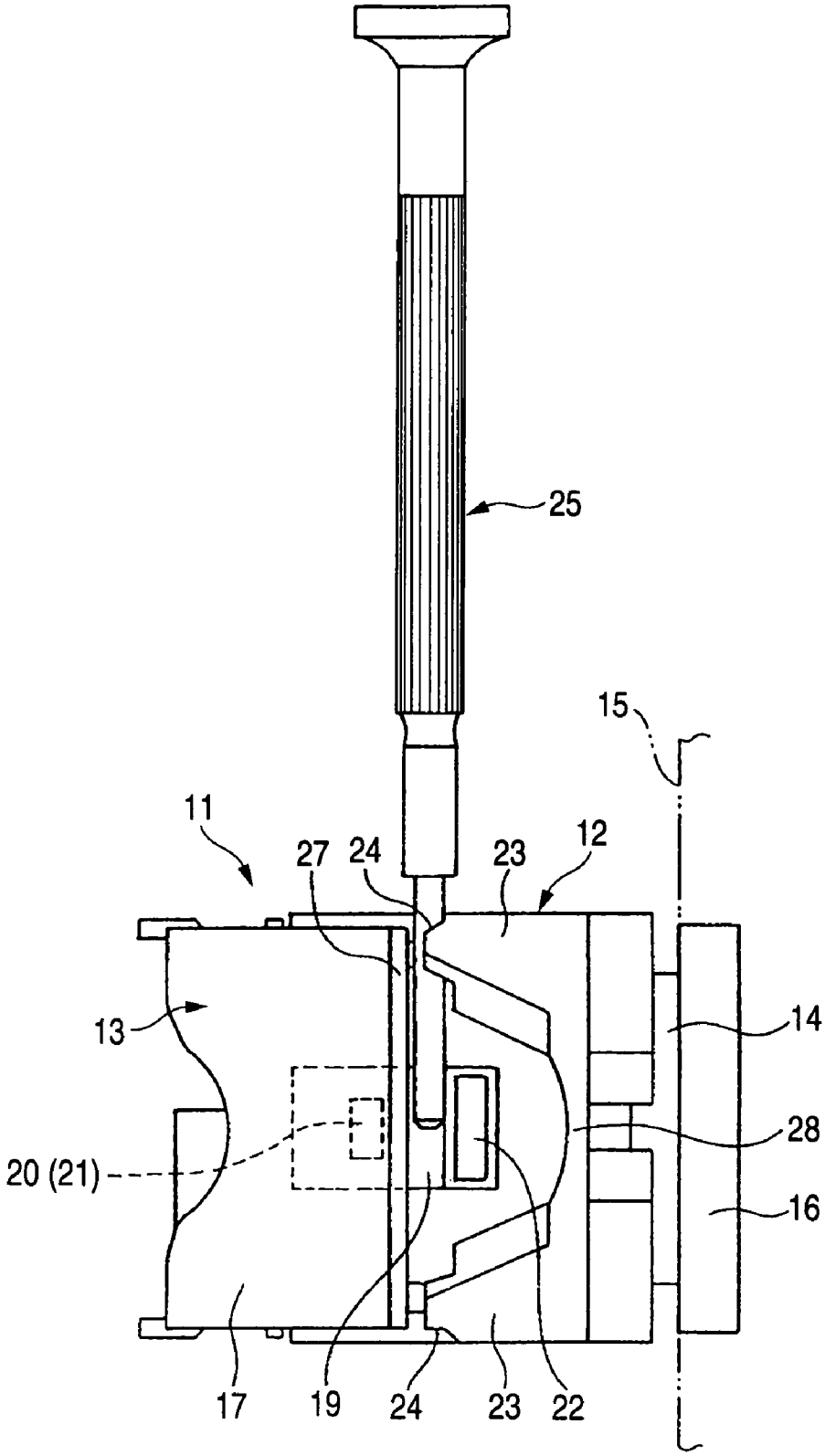
FIG. 2 is a view of the lever fitting-type connector of FIG. 1 as seen in a direction of arrow B.
Figure 3:
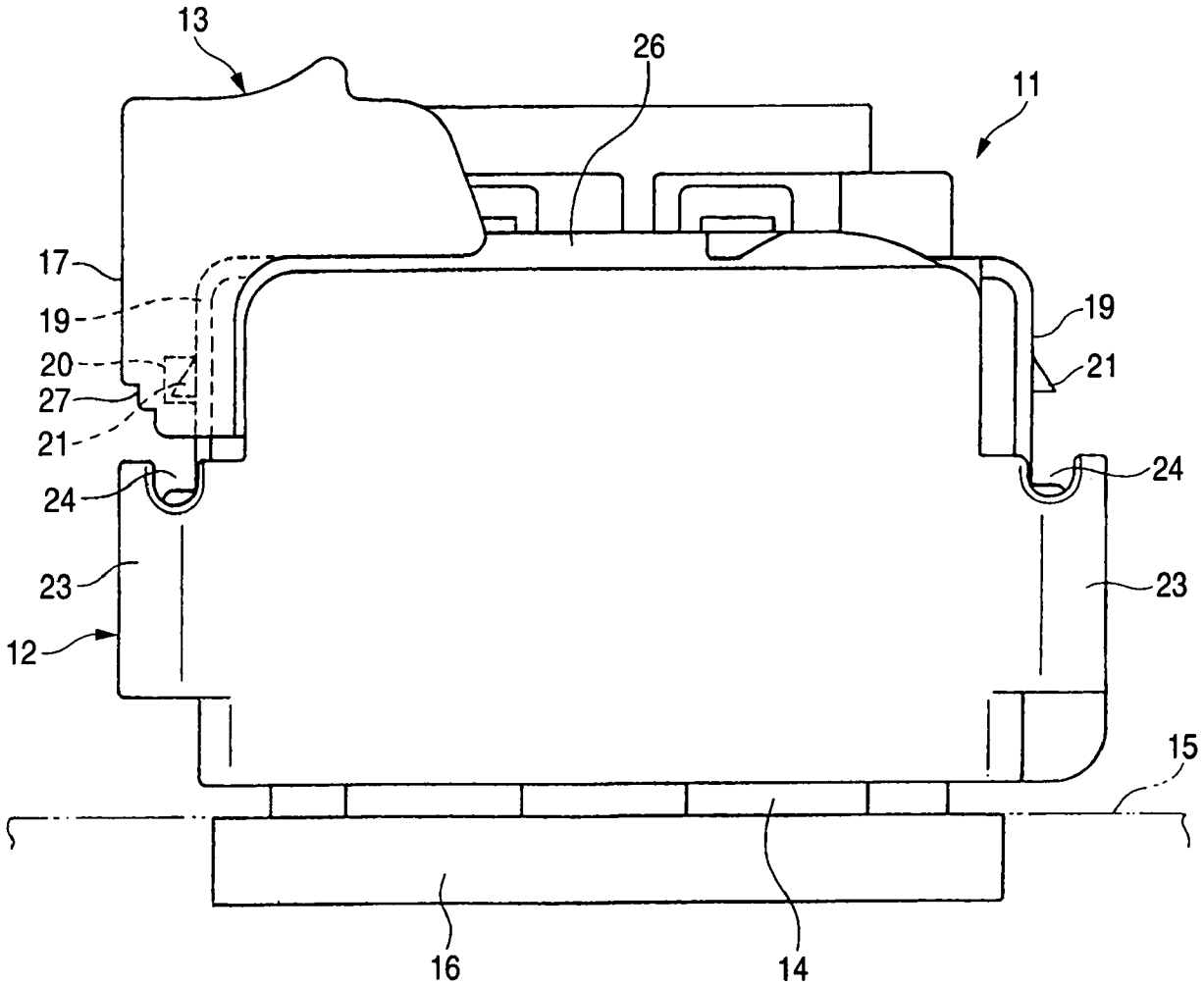
FIG. 3 is a view of the lever fitting-type connector of FIG. 1 as seen in a direction of arrow C.
Figure 4:
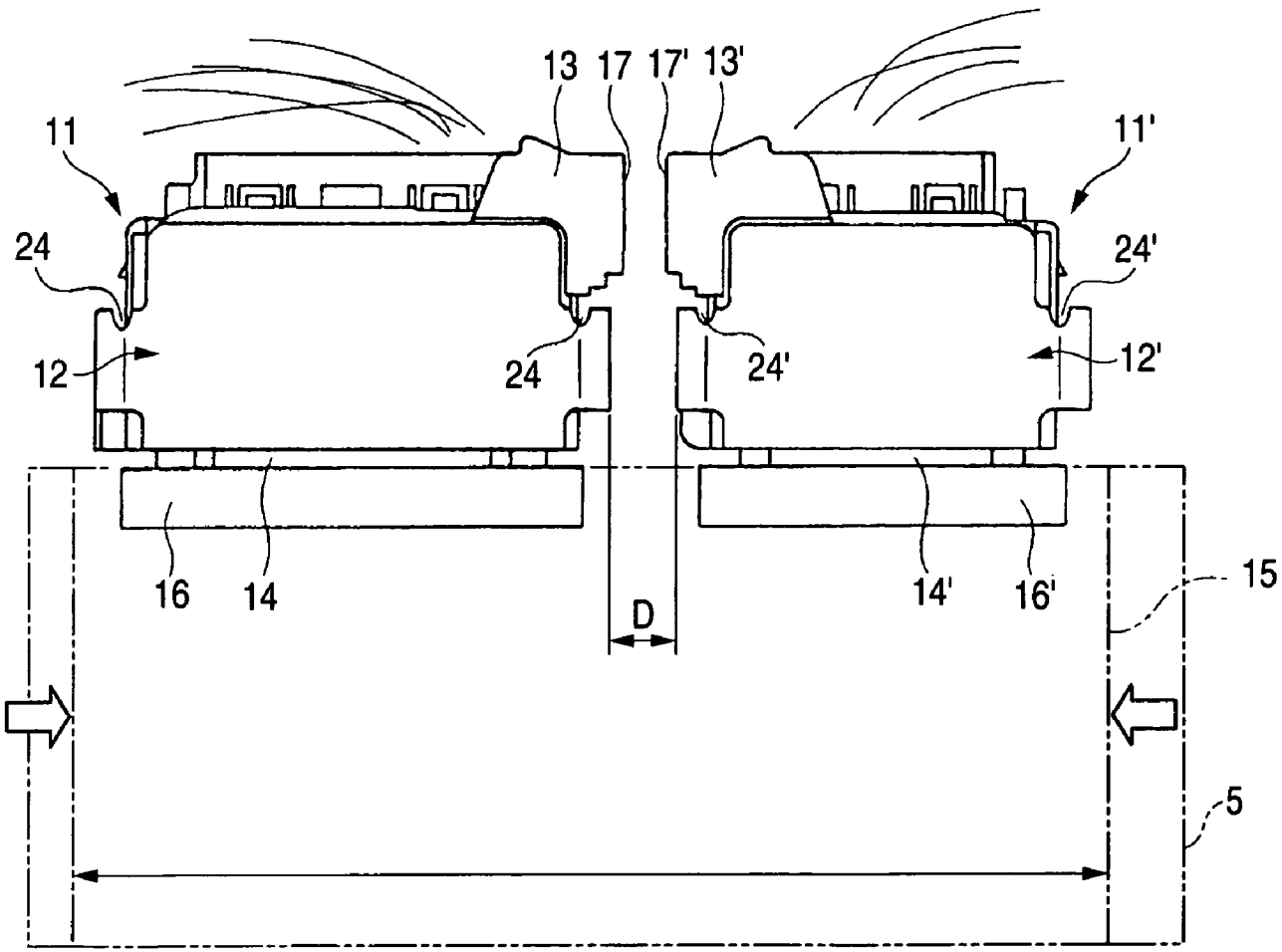
FIG. 4 is a schematic view showing a condition in which an equipment is formed into a compact design.
Figure 5:
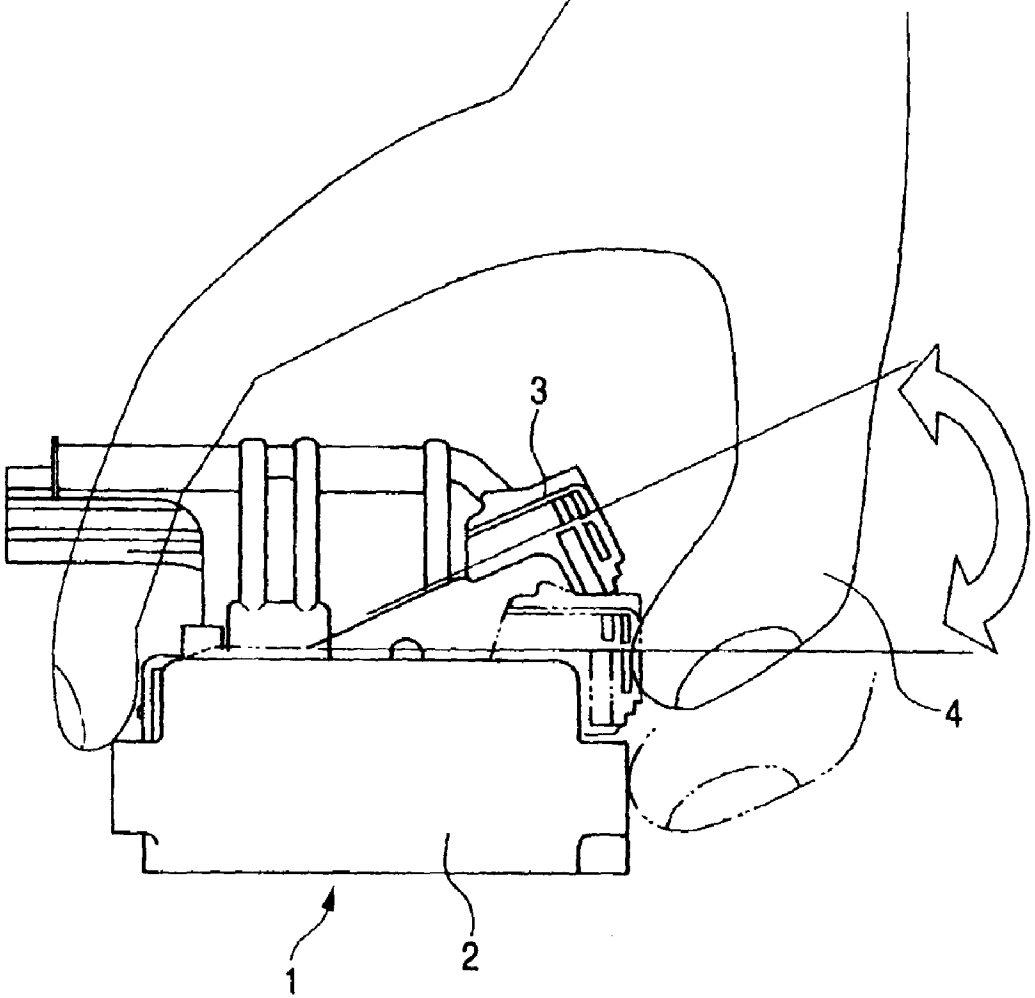
FIG. 5 PRIOR ART
FIG. 5 is a view explanatory of a conventional lever fitting-type connector.

The present invention will now be described with reference to the drawings. FIG. 1 is a perspective view of one preferred embodiment of a lever fitting-type connector of the invention. FIG. 2 is a view of the lever fitting-type connector of FIG. 1 as seen in a direction of arrow B, FIG. 3 is a view of the lever fitting-type connector of FIG. 1 as seen in a direction of arrow C, and FIG. 4 is a schematic view showing a condition in which an equipment is formed into a compact design.

In FIGS. 1 to 4, the lever fitting-type connector 11 of the invention comprises a synthetic resin-made connector housing 12, and a synthetic resin-made lever 13 mounted on this connector housing 12. The lever fitting-type connector 11 is constructed such that the connector housing 12 and a connector housing 14 of a mating connector (to which the connector 11 is adapted to be connected) can be easily fitted together and disconnected from each other by pivotally moving the lever 13 in order to reduce an insertion force required when connecting the two connector housings 12 and 14 together.

The lever fitting-type connector 11 as well as the mating connector has a multi-pole design. The mating connector is mounted on the equipment 15 such for example as a engine control unit. Reference numeral 16 denotes a mounting base formed in a projected manner on a box-like boy of the equipment 15 (or schematically denotes an upper wall). One pair of mating connectors are provided, and are arranged side by side at a predetermined interval D.

The lever fitting-type connector 11 is adapted to be connected to one of the mating connectors. A lever fitting-type connector 11' which is identical in construction to and different in size from the lever fitting-type connector 11 is adapted to be connected to the other mating connector. In this embodiment, when the lever fitting-type connectors 11 and 11' are connected respectively to the mating connectors, lever operating portions 17 and 17' (described later) of levers 13 and 13' are opposed to each other.

The connector housing 12 has a plurality of kinds of terminal receiving chambers 18 formed therein. Although not particularly shown, a metal terminal connected to an end portion of a wire is received in each terminal receiving chamber 18. In FIG. 1, reference character A denotes a portion onto which the wires are led out. The led-out wires are led out in a predetermined direction by a wire cover.

The connector housing 12 has a lock arm 19 for retaining the lever 13. More specifically, the connector housing 12 has two lock arms 19 formed respectively at opposite sides thereof (This is merely one example. In the connector housing 12 of this embodiment, the direction of mounting of the lever 13 can be changed, and therefore the lock arms are formed respectively at the opposites sides.). The lock arm 19 has elasticity, and is formed into a cantilever-like shape.

A retaining projection 21 for retaining engagement with a retaining engagement portion 20 of the lever 13 is formed at an intermediate portion of the lock arm 19. A pressing portion 22 is formed at a free end of the lock arm 19. The pressing portion 22 is used for elastically bending the lock arm 19.

A pair of cover portions 23 are formed at each of the opposite side portions of the connector housing 12. The pair of cover portions 23 are formed for the purpose of protecting the lock arm 19. More specifically, the cover portions 23 are formed for the purpose of preventing the pressing portion 22 of the lock arm 19 from being inadvertently operated or pressed. Each cover portion 23 corresponds to a protection portion recited in the appended claims. A jig guide 24 is formed at each cover portion 23. The jig guide 24 is formed into a groove-like (or a hole-like) shape. The jig guides 24 are disposed generally in registry with the pressing portion 22 of the lock arm 19. The jig guide 24 is formed at the boundary between the lever operating portion 17 (described later) of the lever 13 and the cover portion 23.

The jig guide 24 forms, together with a retaining cancellation jig 25 (described later), a lever arrangement. More specifically, the jig guide 24 serves as a lever fulcrum for the retaining cancellation jig 25 (described later).

The lever 13 includes a pair of support portions 26, and the lever operating portion 17 interconnecting the pair of support portions 26. A cam groove is formed in each support portion 26. The cam grooves are so formed as to guide respective follower pins provided at the connector housing 14 of the mating connector. The support portions 26 extend respectively from opposite ends of the lever operating portion 17. Incidentally, the mechanism for reducing an insertion force when connecting the connector housings 12 and 14 together is not limited to any particular type, and is similar in construction to a conventional mechanism. Also, this mechanism is similar in structure and function to the conventional mechanism.

The lever 13 has a generally U-shape defined by the pair of support portions 26 and the lever operating portion 17. The retaining engagement portion 20 is formed on an inner surface of the lever operating portion 17. The retaining engagement portion 20 is so formed as to be retainingly engaged with the retaining projection 21 of the lock arm 19. A step portion 27 is formed at the outer side of the lever operating portion 17 so that the operator can easily operate the lever.

When the lever 13 is pivotally moved to fit the connector housings 12 and 14 together, the retaining engagement portion 20 is retainingly engaged with the retaining projection 21 of the lock arm 19, and thereafter the lever is prevented from being inadvertently operated.

Next, the operation for canceling the retained condition (locked condition) of the lever 13 and the lock arm 19 will be described with reference to the above construction. In this invention, the retained condition is canceled by either of a first retaining cancellation structure for canceling the retained condition by the finger and a second retaining cancellation structure for canceling the retained condition by the retaining cancellation jig 25.

In the first retaining cancellation structure, the lock arm 19 is elastically bent by pressing the pressing portion 22 with the thumb, thereby canceling the retained condition. Thus, the retained condition is canceled by pressing the pressing portion 22 with the thumb, and in this condition when the lever 13 is pulled up or lifted, the operation for disconnecting the connector housings 12 and 14 from each other proceeds.

In the second retaining cancellation structure, the lock arm 19 is elastically bent by pressing the pressing portion 22 by the use of the retaining cancellation jig 25, thereby canceling the retained condition. Thus, the retained condition can be canceled without the need for pressing the pressing portion 22 with the thumb. Therefore, the second retaining cancellation structure is characterized in that it obviates the need for securing an operation space for the thumb.

The retaining cancellation jig has a rod-like shape as shown in the drawings. The retaining cancellation jig 25 is adapted to be inserted in a direction intersecting the direction of pressing of the lock arm 19. The retaining cancellation jig 25 is inserted into the jig guide 24 of the connector housing 12, and then when a slight force is applied to the retaining cancellation jig 25 in a direction of an arrow, this jig 25 is turned on the jig guide 24 serving as a fulcrum. With this turning movement, the distal end portion of the retaining cancellation jig 25 serves as a point of application, and presses the pressing portion 22. The retained condition is canceled by the retaining cancellation jig 25, and thereafter merely by pulling up the lever 13, the operation for disconnecting the connector housings 12 and 14 from each other proceeds satisfactorily.

Figure 6:
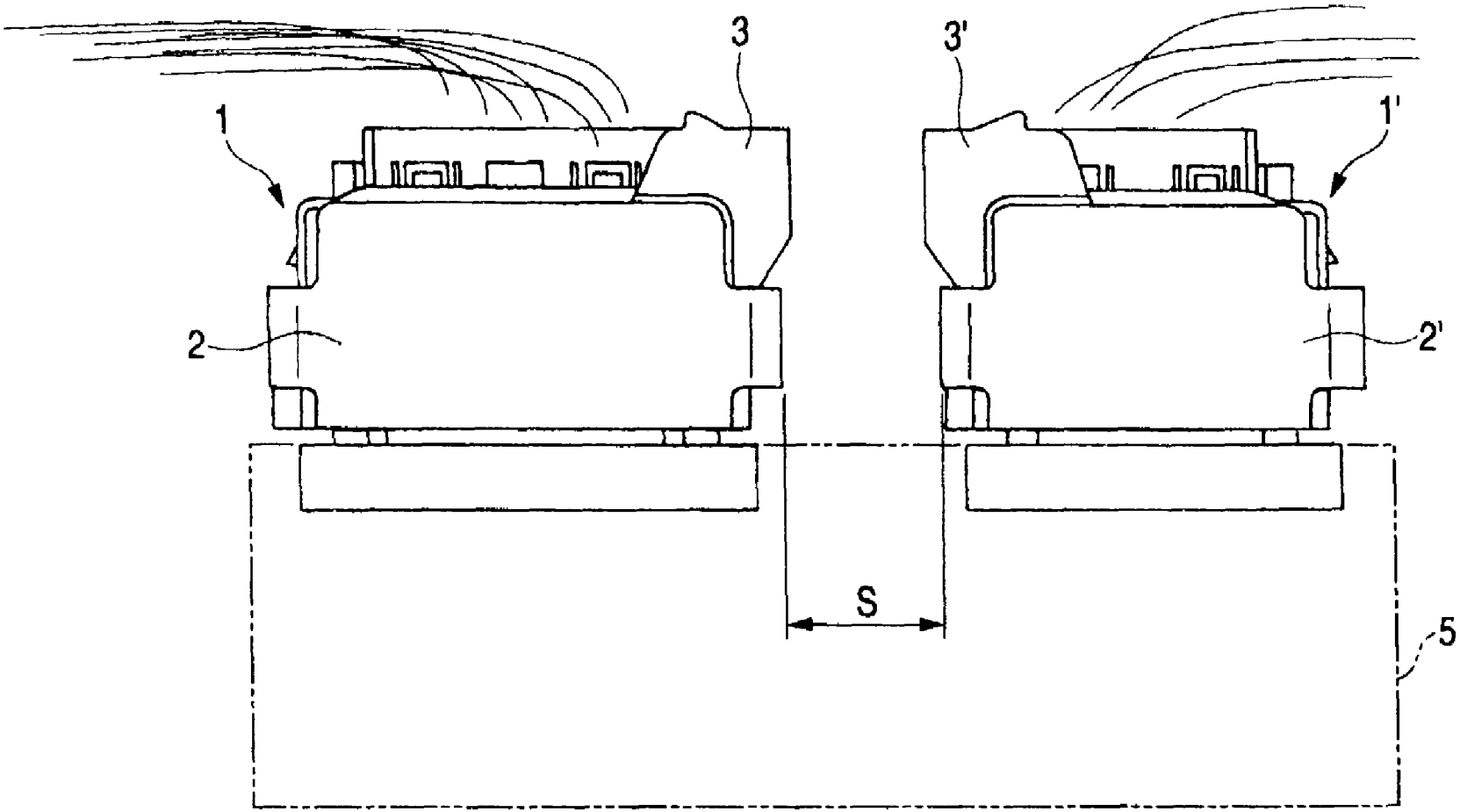
FIG. 6 PRIOR ART
FIG. 6 is a view explanatory of arrangement of lever fitting-type connectors in a conventional equipment.

As described above with reference to FIGS. 1 to 4, the lever fitting-type connector 11 of the invention is of the type in which the retained condition can be canceled by pressing the lock arm 19 with the finger, and alternatively the retained condition can be canceled by pressing the lock arm 19 by the use of the retaining cancellation jig 25. The lever fitting-type connector 11 of the invention has such a structure that the retained condition of the lever 13 and the lock arm 19 can be canceled even when a sufficient operation space for enabling the finger to cancel the retained condition is not available. Therefore, there is achieved an advantage that the distance or gap D between the lever fitting-type connectors 11 and 11' can be made smaller than the operation space S (see FIG. 6) (D<S). And besides, there is achieved an advantage that the equipment 15 can be made compacter than the conventional equipment 5.

In the present invention, various modifications can be made without departing from the subject matter of the invention.

Incidentally, the jig guide 24 need only to serve as the lever fulcrum for the retaining cancellation jig 25, and may be formed at any other suitable portion than the cover portion 23. For example, the jig guide 24 may be formed at the lever operating portion 17 of the lever 13 or an interconnecting proximal end portion 28 interconnecting the pair of cover portions 23. These portions have the function of preventing the lock arm 19 from being inadvertently operated, and therefore correspond to the protection portion recited in the appended claims. The second retaining cancellation structure is so constructed as to enable the retained condition to be canceled from the direction different from the direction of pressing of the lock arm 19.

What is claimed is:

1. A lever fitting-type connector comprising:

a lock arm for retaining a lever, a first retaining cancellation structure for canceling a retained condition of said lever by the lock arm using a finger, and a second retaining cancellation structure for canceling the retained condition of said lever by the lock arm by inserting a retaining cancellation jig in a direction intersecting a direction of pressing of said lock arm and then operating said jig, wherein said second retaining cancellation structure is provided at a protection portion which protects said lock arm and wherein the first and second retaining cancellation structure are part of the connector.

2. A lever fitting-type connector according to claim 1, wherein said second retaining cancellation structure provided at said protection portion includes a jig guide serving as a lever fulcrum for said retaining cancellation jig.

3. A lever fitting-type connector according to claim 2, wherein said jig guide has a groove-like shape.

* * * * *